US006020801A

United States Patent [19]

Passow

[11] Patent Number: 6,020,801

[45] Date of Patent: Feb. 1, 2000

[54] TRIP MECHANISM FOR AN OVERLOAD RELAY

[75] Inventor: Christian Henry Passow, Batavia, Ill.

[73] Assignee: Siemens Energy & Automation, Inc., Alpharetta, Ga.

[21] Appl. No.: 09/300,502

[22] Filed: Apr. 28, 1999

Related U.S. Application Data

[62] Division of application No. 08/838,904, Apr. 11, 1997.

[51] Int. Cl.[7] ..... H01H 51/22

[52] U.S. Cl. ..... 335/78; 335/80; 335/113

[58] Field of Search ..... 335/78–86, 113–117, 335/124, 126–131

[56] References Cited

U.S. PATENT DOCUMENTS

| | | | |
|---|---|---|---|
| 1,839,095 | 12/1931 | Goetz . | |
| 2,283,795 | 5/1942 | Dahl . | |
| 2,616,010 | 10/1952 | Scheib, Jr. . | |
| 3,597,562 | 8/1971 | Turnbull . | |
| 3,655,934 | 4/1972 | Turnbull . | |
| 3,728,510 | 4/1973 | Wallace et al. . | |
| 3,864,649 | 2/1975 | Doyle | 335/166 |
| 3,925,742 | 12/1975 | Muench | 335/186 |
| 3,993,971 | 11/1976 | Ono et al. | 335/202 |
| 4,087,770 | 5/1978 | Kuhn et al. . | |
| 4,181,907 | 1/1980 | Esposito et al. | 335/170 |
| 4,325,043 | 4/1982 | Kimpel . | |
| 5,179,495 | 1/1993 | Zuzuly . | |
| 5,394,127 | 2/1995 | Hendel | 335/78 |
| 5,910,759 | 6/1999 | Passow | 335/78 |

*Primary Examiner*—Lincoln Donovan

[57] ABSTRACT

Simplicity and reliability in a trip mechanism for an overload relay is achieved in a construction including a housing containing a bistable armature mounted on a pivot for movement between two stable positions. Fixed contacts are located within the housing and moveable contacts are carried by the armature for movement to a closed position with the fixed contacts for one of the two stable positions and for movement to an open position relative to the fixed contacts for the other of the two stable positions. A latch arm is carried by the armature and has a latch surface thereon. A torsion spring is mounted on the housing and has a latch finger for engaging the latch surface and retaining the armature in one of the two positions. A push button is provided for disabling the latch finger.

12 Claims, 8 Drawing Sheets

TRIP MECHANISM FOR AN OVERLOAD RELAY

This is a divisional of application Ser. No. 08/838,904 filed Apr. 11, 1997.

FIELD OF THE INVENTION

This invention relates to electrical relays, and more specifically to a trip mechanism for an overload relay.

BACKGROUND OF THE INVENTION

Overload relays are electrical switches typically employed in industrial settings to protect electrical equipment from damage due to overheating in turn caused by excessive current flow. In a typical case, the electrical equipment is a three phase motor which is connected to a power source through another relay commonly referred to as a contactor. A typical contactor is a heavy duty relay having three switched power paths for making and breaking each of the circuits connected to the three phase power source. The motion required to make and break the contacts is provided magnetically as the result of power flow through a coil which in turn is energized by current whose flow is controlled by another switch, typically remotely located.

In a conventional set up, an overload relay is connected in series with the control switch for the coil of the contactor. When an overload condition is detected by the overload relay, the same cuts off power to the coil of the contactor, allowing the contactor to open and disconnect the electrical equipment that is controlled by the contactor from the source of power to prevent injury to the electrical equipment.

In the past, overload relays have utilized resistive heaters for each phase which are in heat transfer relation with a bimetallic element which in turn controls a switch. When an overload is sensed, as, for example, when there is sufficient heat input from the resistive heater to the bimetallic element, the bimetallic element opens its associated switch to de-energize the contactor coil and disconnect the associated piece of electrical equipment from the source of power.

More recently, the resistive heater-bimetallic element type of relay has been supplanted by electronic overload relays. See, for example, commonly assigned U.S. Pat. No. 5,179,495 issued Jan. 12, 1993, to Zuzuly, the entire disclosure of which is herein incorporated by reference. Outputs of such circuitry typically are relatively low powered and as a consequence, in order for the output to control the contactor coil current, a solid state switch may be required.

In one case, an overload relay, once tripped, will remain in an open position, preventing the flow of current to the contactor, and must be manually reset. Usually, a push button is employed so that the person operating the equipment may push the push button to cause a reset of the system, closing the contacts of the overload relay to again allow current to flow to the contactor coil which in turn will close the contactor contact and provide current to the electrical equipment.

At the same time, applicable standards require that the construction of the push button and associated mechanical components be such that the overload relay contacts may open in the event of an overload even when the push button has been pushed for reset purposes. While this will prevent damage to the electrical equipment if an overload condition occurs or continues during the process of resetting the overload relay, the purpose of the rule is to require that the overload relay construction be such that it cannot be defeated by holding down or jamming the push button in the reset position. An overload relay having such a feature is known as a "trip free" overload relay.

In some instances, it is also desirable to provide a means whereby an overload relay will automatically reset, assuming that the overload condition that tripped it in the first place has been alleviated in the meantime. In such cases, the trip mechanism will periodically receive a reset signal from the control circuitry and the mechanical construction should be such that resetting will occur automatically without manipulation of a reset push button or the like.

It is also desirable that an overload relay be provided with means whereby the relay condition may be switched manually for test purposes. Thus, the overload relay should be capable of being reset or tripped manually without manipulating a reset push button or actually encountering an overload.

In many instances, it is also desirable that the overload relay be provided with a means that may be utilized to momentarily interrupt flow of power to the piece of electrical equipment being monitored by the overload relay.

The present invention is directed to providing an overload relay having the foregoing capabilities and features along with others in a reliable, mechanical trip mechanism that can be economically manufactured.

SUMMARY OF THE INVENTION

It is the principal object of the invention to provide a new and improved trip mechanism for an overload relay. More particularly, it is an object of the invention to provide such a mechanism that may be reset through manual or automatic resetting modes and which is "trip free" as that term is known in the art. It is also an object of the invention to provide such an overload relay that may be tripped or reset for test purposes and which include a means whereby power to electrical equipment can be temporarily interrupted through manual operation.

According to one facet of the invention, there is provided a trip mechanism for an overload relay that includes a housing with a bistable armature mounted in the housing on a pivot for pivotal movement between two stable positions. Fixed contacts are located within the housing and movable contacts are carried by the armature for movement to a closed position with the fixed contacts for one of the two stable positions and for movement to an open position relative to the fixed contacts for the other of the two stable positions. A latch arm is carried by the armature and has a latch surface thereon. A spring is mounted on the housing and has a latch finger for engaging the latch surface and retaining the armature in one of the two positions. Means are provided for selectively disabling the latch finger.

In a preferred embodiment, the disabling means comprise a manual operator, which even more preferably, is in the form of a push button reciprocally mounted on the housing for movement toward and away from the latch arm.

In one embodiment, a detent is located in the housing and is selectively engagable by the push button to hold the push button in a position disabling the latch finger.

In a preferred embodiment, an additional spring is carried by the latch arm and has a reset finger moveable into the path of reciprocal movement of the push button when the armature is in the one position thereof. The push button further includes a stop surface facing the reset finger and engaged thereby when the push button is reciprocated to cause the finger to push the latch arm and the armature to the other of the two positions for resetting purposes.

According to another facet of the invention, there is provided a trip mechanism for an overload relay which includes a housing, an elongated armature on a pivot in the housing for pivotal movement between two positions and a post extending from one side of the armature at a location spaced from the pivot. A fulcrum is located on the post and an elongated contact bar is mounted intermediate at ends on the post. A spring is carried by the armature and biases the contact bar against the fulcrum while a pair of spaced fixed contacts are mounted in the housing in position to be bridged by the contact bar for one of the two positions and spaced from the contact bar for the other of the two positions. The construction is such that opening and closing of the contacts results in a wiping motion of the contact which is particularly desirable to achieve good electrical conductance at low voltage and/or low current values.

In a preferred embodiment, a contact leveling rib is located on the housing for engaging the contact bar when the armature is in the other of the two positions and for maintaining the contact bar nominally parallel to the fixed contacts.

According to still another facet of the invention, there is provided a trip mechanism for an overload relay that includes a housing, an armature mounted for movement in the housing between two positions, fixed contacts on the housing, and moveable contacts carried by the armature for movement toward and away from the fixed contacts. A moveable lever is associated with the armature and is operable to shift the armature from at least one of the two positions to the other of the two positions. An operator is provided for the lever and includes an element moveable toward and away from the lever. A spring finger is carried by either the lever or the operator and extends at an acute angle therefrom toward the other of the lever and the operator. A stop surface is located on the other of the lever and the operator and is positioned to be engaged by the spring finger when the armature is in the one position and the operator is moved toward the lever. The stop surface disengages and releases the spring finger when the armature has moved to the other of the two positions.

In a preferred embodiment, the spring is a torsion spring having a coil mounted on a post and the spring finger extends from the coil.

In a highly preferred embodiment, the post is on the lever and the stop surface is on the operator which, in turn, is preferred to be a manual operator. Even more preferably, the manual operator is a push button reciprocally mounted in the housing.

In a preferred embodiment, the push button additionally is rotatably mounted in the housing and further includes a detent engagable by rotating the push button for holding the push button in a desired position relative to the lever to effect an automatic resetting mode.

In a highly preferred embodiment, a latch surface is located on the lever and a second torsion spring has a coil mounted on the housing with a latch finger extending therefrom towards the latch surface to latchingly engage the same when the armature is in the one position. The push button is disposed to disengage the latch finger from the latch surface when the push button is moved toward the lever and before the spring finger engages in the stop surface.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DESCRIPTION OF THE PREFERRED EMBODIMENTS

Figure 1:
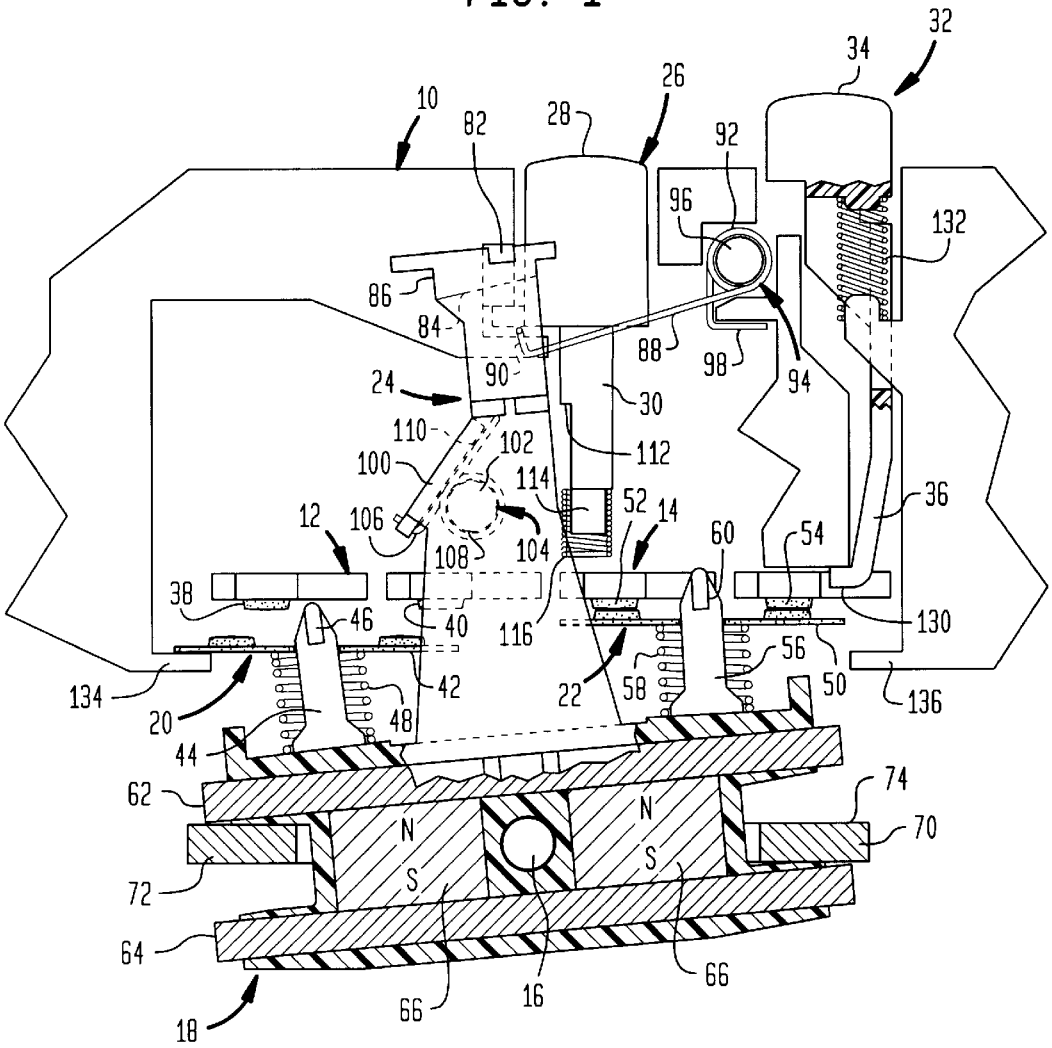
FIG. 1 is a partially schematic elevational view of a trip mechanism made according to the invention with the components in a configuration corresponding to an automatic reset mode.
Figure 2:
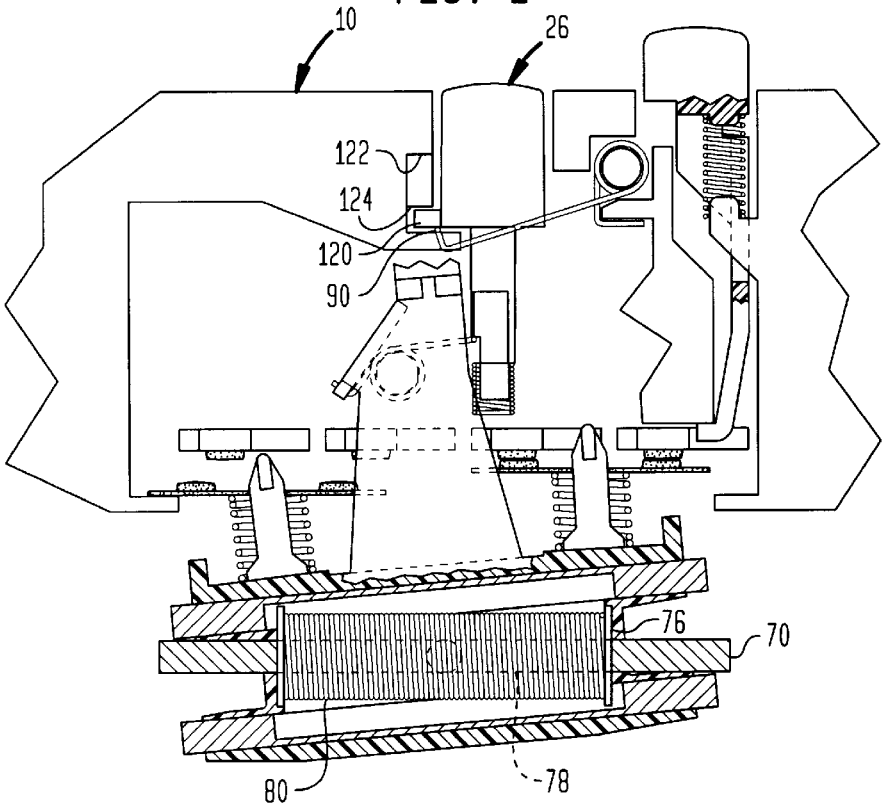
FIG. 2 is a view similar to FIG. 1 with parts, however, broken away for clarity.

Referring to FIGS. 1 and 2, the overload relay is shown in a reset position and includes a housing, generally designated 10, mounting a first set of normally open, fixed contacts, generally designated 12 and a set of normally closed, fixed contacts, generally designated 14. The housing includes a pivot pin 16 upon which an elongated, bi-stable armature, generally designated 18, is pivoted. The armature 18 carries a first set of movable contacts, generally designated 20, and a second set of movable contacts, generally designated 22, which cooperate with the fixed contacts 12 and 14 respectively.

A latch lever, generally designated 24 is connected to the armature 18 to be moveable therewith and thus will rock about the pivot 16 between the two stable positions of the armature 18.

The housing mounts a manual operator, generally designated 26 which includes a push button 28 and a depending shank 30. The same is mounted for reciprocating movement within the housing 10 generally toward and away from the latch lever 24. A manual stop operator, generally designated 32 is also reciprocally mounted within the housing 10 and includes an upper push button 34 and a lower shank 36 which is operative to open the normally closed contacts 14, 22 under certain conditions.

Turning to the fixed contacts 12, the same includes two electrically and physically spaced contacts 38 and 40. The contacts 38 and 40 are adapted to be bridged by an elongated contact bar 42. The contact bar 42 is elongated in the same direction as the armature 18 and is loosely mounted at its midpoint on a post 44 that extends from the armature 18 in a direction generally transverse to its direction of elongation and to one side of the pivot 16. The post 44, adjacent its upper end, includes a cross member 46 which acts as a fulcrum for the contact bar 42. A spring 48 carried by the armature 18 biases the contact bar 42 against the fulcrum 46.

The normally closed contacts 14, 22 include essentially identical components including an elongated contact bar 50 that is adapted to bridge a pair of electrically and physically spaced fixed contacts 52 and 54. The contact bar 50 is carried by a post 56 on the armature 18 and biased by a spring 58 against a cross member 60 which also defines a fulcrum for the cross member 50. It will be observed that the cross members 46 and 60 engage their respective contact bars 42, 50 at approximately the midpoint of the latter.

Turning now to the armature 18, the same includes a first magnetic pole piece 62 and a parallel, spaced second magnetic pole piece 64. The pole pieces 62 and 64 sandwich the pivot 16 as well as two permanent magnets 66. The permanent magnet 66 could be a unitary structure. For convenience, to accommodate the pivot 16, it is shown as two separate magnets.

The housing 10 mounts magnetic yoke or pole piece 70 which is in the form of a shallow U having legs 72 and 74 located between the pole pieces 62 and 64. As seen in FIG. 2, a bobbin 76 is disposed about the bight 78 of the pole piece 70 and an electrical conductor 80 is wound thereon to form electrical coil. In some cases, a single coil will be wound on the bobbin 76 while in other cases, two electrically separate coils will be wound thereon, one on top of the other. The particular arrangement depends upon the control mode of the electronic circuitry. If the same reverses current flow through the coil 80 to switch the relay from one state to the other, only a single coil need be used. On the other hand, if the same does not reverse current flow, but rather switches it from one coil to the other, then two coils, oppositely wound from one another, will be employed as the electrical conductor 80.

Figure 4:
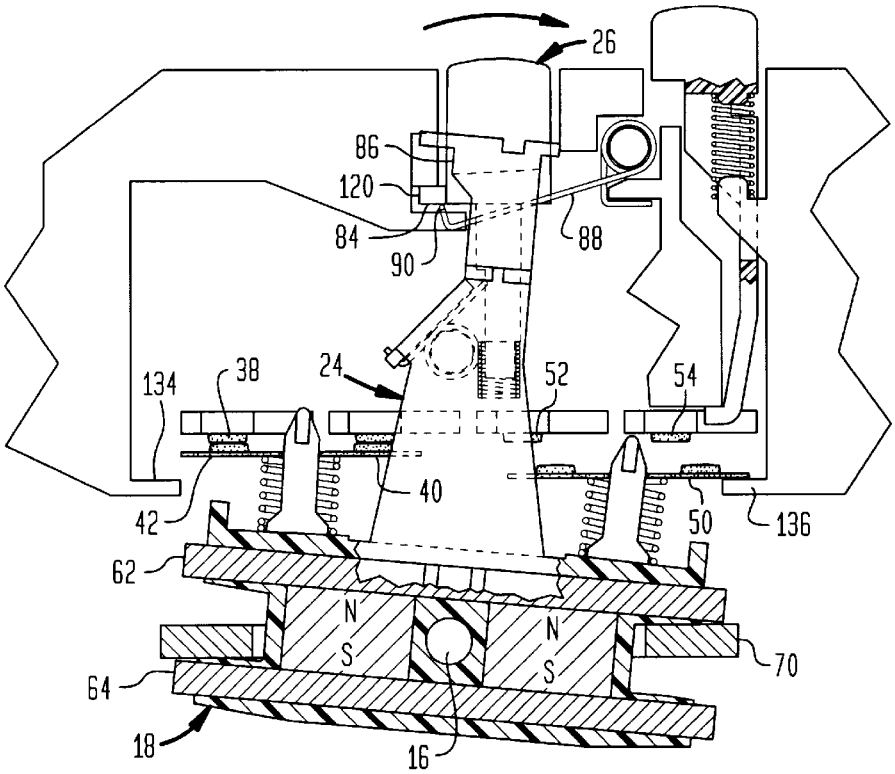
FIG. 4 illustrates the configuration of the components after a trip has occurred while in the automatic reset mode.

Turning now to the latch lever 24, the same is movable within the housing 10 with the armature 18 between the positions shown in FIG. 1 and FIG. 4. At its upper end, it includes an elongated notch 82 which underlies an opening (not shown) in the housing 10. A tool, such as the tip of a screwdriver can be fitted through the opening and inserted into the notch 82 to apply a manual force to the lever 24 to shift it between the positions shown in FIG. 1 and FIG. 4 for manual test purposes.

Just below the notch 82, a latch surface defined by two adjoining surfaces 84 and 86 is provided. Underlying the latch surface 84, 86 is a spring latching finger 88 having an upturned end 90 that is adapted to embrace the surface 86 of the latch surface 84 and 86 under certain conditions to be described. The latch finger 88 extends from a coil 92 of a torsion spring, generally designated 94, which is mounted on a post 96 or within a pocket within the housing 10. Alternatively, the spring 94 may be mounted on the latch lever and the latch surface 84 and 86 located on the housing 10.

The end 98 of the coil 92 opposite the latch finger 88 is abutted against housing 10 to prevent rotation of the coil 92 on the post 96. The latch finger 88 may latch the latch lever 24 in one of the two stable positions of the armature 18. Such an occurrence is illustrated in, for example, FIG. 6 and 7.

The latch lever 24 also carries a flat, diagonal projection 100 closely adjacent to a post 102 which is generally parallel to the pivot 16. A second torsion spring, generally designated 104, is mounted on the post 102 and includes one end 106 fixed to the projection 100 to prevent rotation of the coil 108 of the torsion spring about the post 102. The opposite end 110 of the torsion spring 104 acts as a reset finger and extends diagonally, at an acute angle past the end of the projection 100 in the direction of the push button 26. In this connection, the shank 30 of the push button 26 includes a notch 112 which acts as a stop surface and cooperates with the reset finger 110 for shifting the latch lever 24 from the position illustrated in FIG. 4, that is, the tripped position, to the reset position illustrated in FIG. 1.

Turning now to the push button 26, the lower end of the same includes a ledge 114 against which a biasing spring 116 is abutted. The biasing spring 116 provides an upward bias to the push button 26 to bias the same toward the position illustrated in FIG. 5, for example.

The push button 28 of the operator 26, just above the shank 30 includes an outwardly extending tongue or ledge 120, best seen in FIG. 2. At the same time, the housing 10 includes a first notch having a retaining surface 122 and a second notch having a detent surface 124. As illustrated in FIG. 2, the retaining surface 122 is above and in front of the detent surface 124. As seen in, for example, FIG. 5, the ledge 120 may abut the retaining surface 122 to hold the manual operator 26 within the housing 10.

Preferably, the operator 26 is made generally cylindrical, except for the ledge 120, so as to be rotatable within the housing 10 as well as reciprocal therein. As a consequence, when the operator 26 is pushed downwardly to the position illustrated in FIG. 1, for example, the same may be rotated to bring the ledge 120 into underlying relation with the detent surface 124. In this position, the operator 26 is restrained in its lower most position which corresponds to the automatic reset mode.

It is to be particularly observed, and as can be seen in FIGS. 1 and 2 for example, in the automatic reset mode, the ledge 120 abuts the upper end 90 of the latch finger 88. As seen in FIG. 1, this holds the latch finger 88 out of engagement with the latch surface 84, 86 on the latch arm 24.

Figure 11:
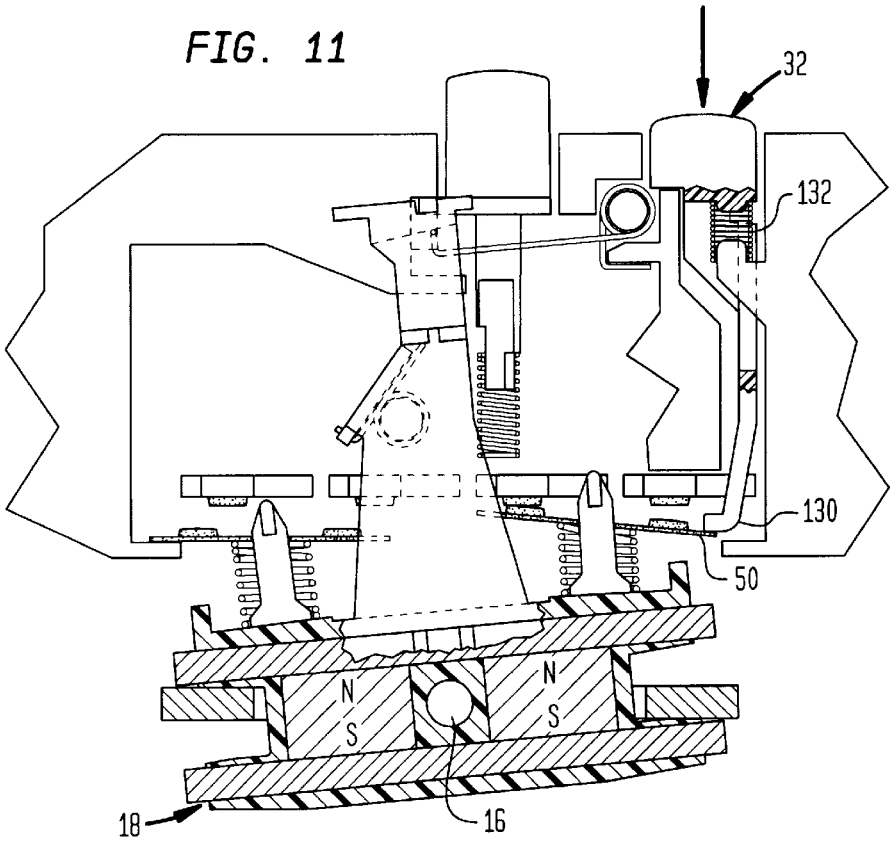
FIG. 11 illustrates the configuration of the components during an operation to cause momentary de-energization of the electrical equipment being monitored by the overload relay.

Turning now to the stop operator 32, the same, as mentioned previously, includes a push button 34 that extends from the housing 10 and a depending shank 36 having a lower end 130 overlying an end of the contact bar 50. A biasing spring 132 biases the stop operator 32 to the position shown in FIG. 1. However, it will be appreciated that the push button 34 may be depressed against the bias provided by the spring 132 to bring the end 130 into abutment with the contact bar 50 of the normally close set of contacts 14, 22. When this occurs, the contact bar 50 may be separated from the contact 54 to break the circuit associated therewith. The physical arrangement of the components when such occurs is illustrated in FIG. 11.

The physical construction of the assembly is completed by first and second contact leveling ribs 134 and 136 for the contact bars 42 and 50, respectively. The leveling ribs 134 are disposed on the housing 10 and extend inwardly toward the armature 18 so as to underlie the end of the associated contact bar 42, 50 most remote from the pivot 16. The leveling ribs 134 and 136 are disposed so that when their respective contact bar 42, 50 is in an open position in relation to the associated set of fixed contacts 12, 14, the contact bar 42 or 50 will be nominally parallel to a line between the two contacts (38 and 40 in the case of the fixed contacts 12 and 52 and 54 in the case of the fixed contacts 14) when in an open position. This relationship is shown for the contact bar 42 in FIG. 1, for example and for the contact bar 50 in FIG. 4 for example. The purpose of this construction and the advantages obtained hereby will be described hereinafter.

With reference to FIGS. 1 and 2, the mechanism is shown in a reset position with the mechanism set to the automatic reset mode. The armature 18 is in one of its two stable positions (i.e. first position) with the contact bar 50 bridging the normally closed fixed contacts 52, 54. Typically, the fixed contacts 52 and 54 would be placed in series with a contactor controlling the piece of electrical equipment that is to be monitored by the overload relay.

At this time, the contact bar 42 is spaced from the contacts 38 and 40 of the fixed contact assembly 12. This set of contacts might be used to operate, for example, an indicator light or the like to indicate that the relay has been tripped, since the contact bar 42 will bridge the contacts 38 and 40 for the other stable position of (i.e. second position) the armature 18, which corresponds to a tripped position.

Figure 3:
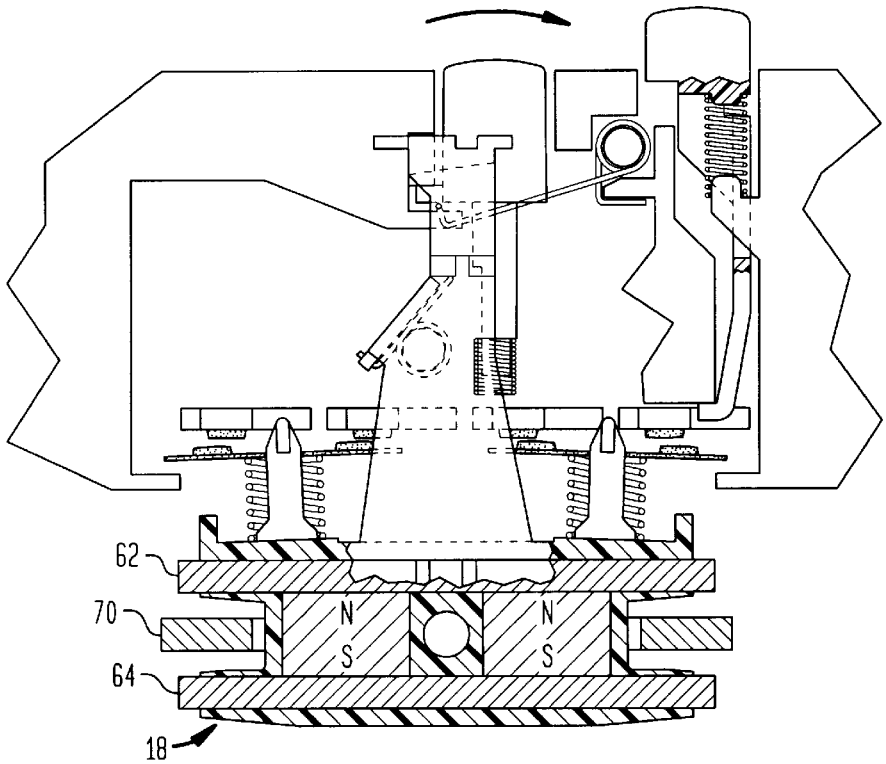
FIG. 3 is a view showing the components as the overload relay is tripping with the components in the automatic reset mode.

FIG. 3 illustrates the configuration of the components in the process of tripping while configured in the automatic reset mode. As can be readily appreciated, the armature is in an unstable mode, being located approximately midway between its two stable positions, that is with the pole pieces 62 and 64 substantially equally spaced from the legs of the yoke 70. This condition is brought about by a control signal placed on the electrical conductor 80 to create a magnetic force in the yoke 70 capable of switching the armature 18 from the position illustrated in FIGS. 1 and 2 to that illustrated in FIG. 4.

FIG. 4 thus shows a configuration of the components with the mechanism tripped. In this instance, the mechanism is configured to be in the automatic reset mode.

The contact bar 50 is no longer bridging the contacts 52 and 54, allowing the control circuit for the contactor for the piece of electrical equipment being monitored by the relay to be de-energized, thus breaking the flow of power thereto. At the same time, the contact bar 42 is closed against the contacts 38 and 40 which may be used to complete a circuit for an indicator light or the like to indicate that the overload really has been tripped as mentioned previously. It is to be particularly observed that at this time, the projection 120 on the push button operator 26 is blocking the upper end 90 of the latch finger 88 from moving into engagement with the latch surface 84, 86 on the latch arm 24. Consequently, if a resetting pulse is applied to the coil 80 to reverse the magnetic field originally applied to the yoke 70, the latch finger 88 will not prevent the resulting magnetic forces from returning the components to the configuration illustrated in FIG. 1, which, it will be recalled, is the reset position.

Figure 5:
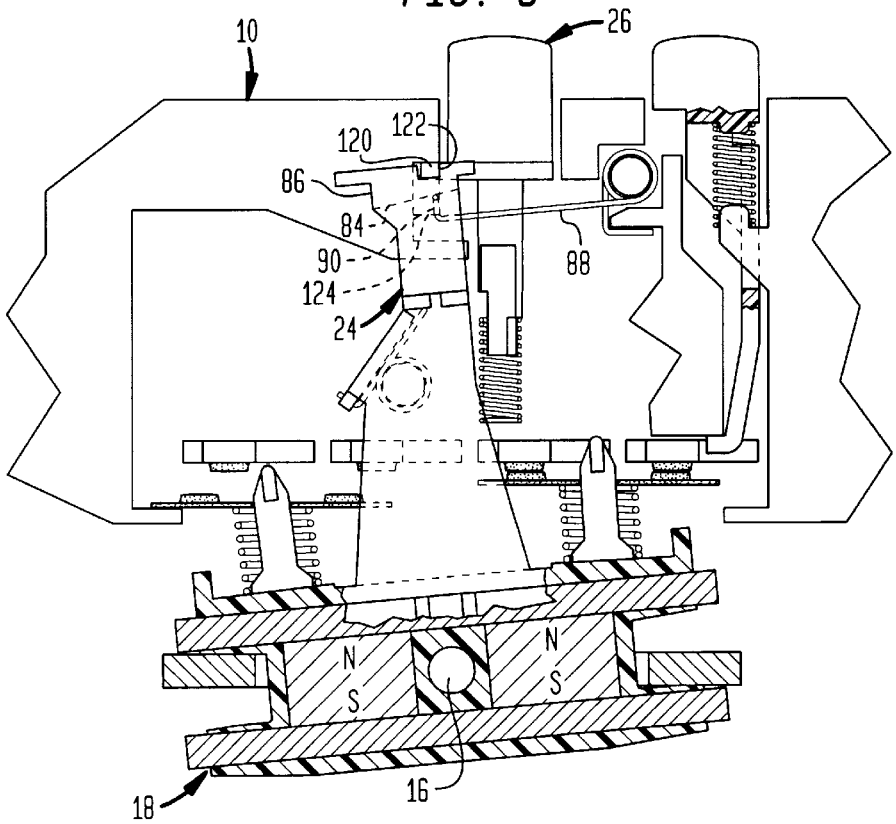
FIG. 5 illustrates the configuration of the components with the mechanism in a reset position while in a manual reset mode.
Figure 6:
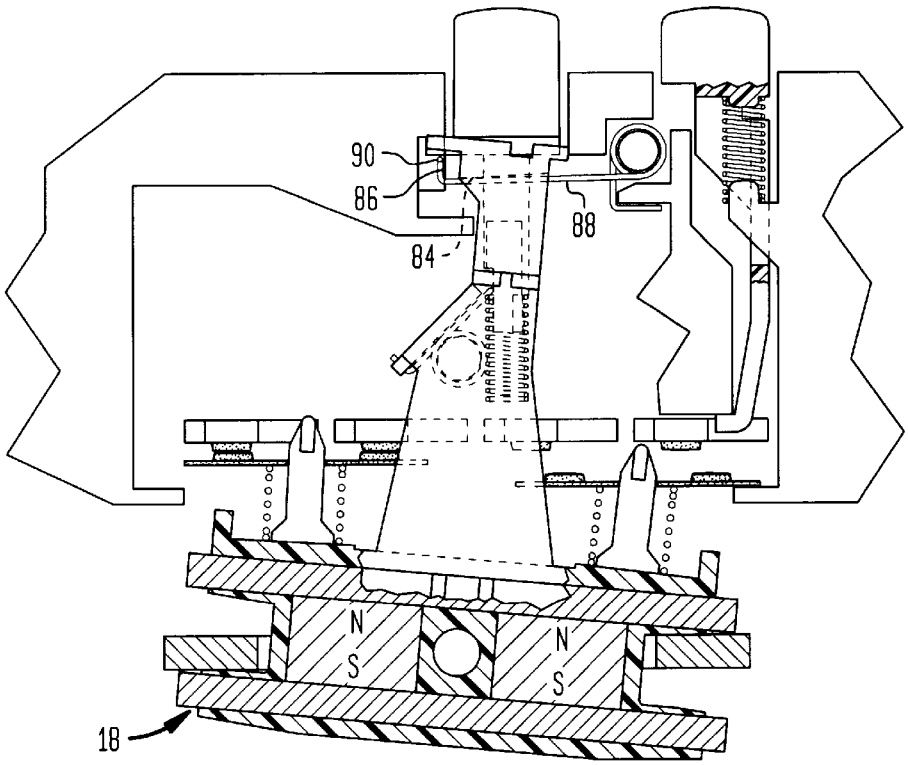
FIG. 6 is a view of the components in the manual reset mode and in a tripped condition.
Figure 7:
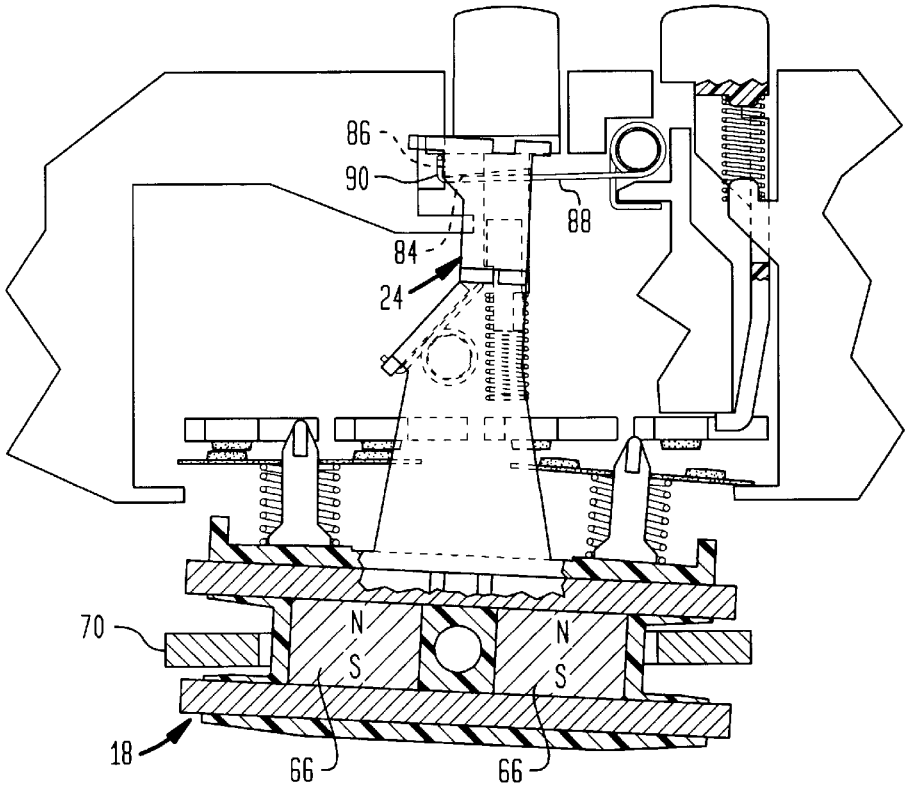
FIG. 7 illustrates the configuration of the components during an attempt at automatic reset.

Turning now to FIG. 5, the reset position of the various components is illustrated for the manual reset mode. In this situation, the push button operator 26 has been rotated so that the projection 120 thereon rests against the retaining surface 122 rather than underlying the detent surface 124. The upper end 90 of the latch finger 88 is in abutment with the surface 84 forming part of the latch surface 84, 86. If a trip signal is provided to the electrical conductor 80 (FIG. 2) to drive the armature 18 in a clockwise direction about the pivot 16, the latch arm 24 will rock in a clockwise direction and the latch finger 88 will latch against the latch surface 84, 86 as illustrated in FIG. 6 and hold the armature 18 in the tripped position. In the event a reset pulse is now applied to the conductor 80 (FIG. 2), the attempt at resetting will be defeated by the fact that the latch finger 88 is preventing full movement of the latch arm 24 in a counterclockwise direction. The armature 18 may move a short distance away from its stable, tripped position as can be seen from a comparison of FIGS. 6 and 7 but will not move any further due to the restraint provided by the latch finger 88. All the while, the condition of the contacts remains unchanged. As a consequence, when the automatic reset pulse is removed from the conductor 80, the magnetic field set up by the permanent magnets 66 will cause the components to return to the position illustrated in FIG. 6.

Figure 8:
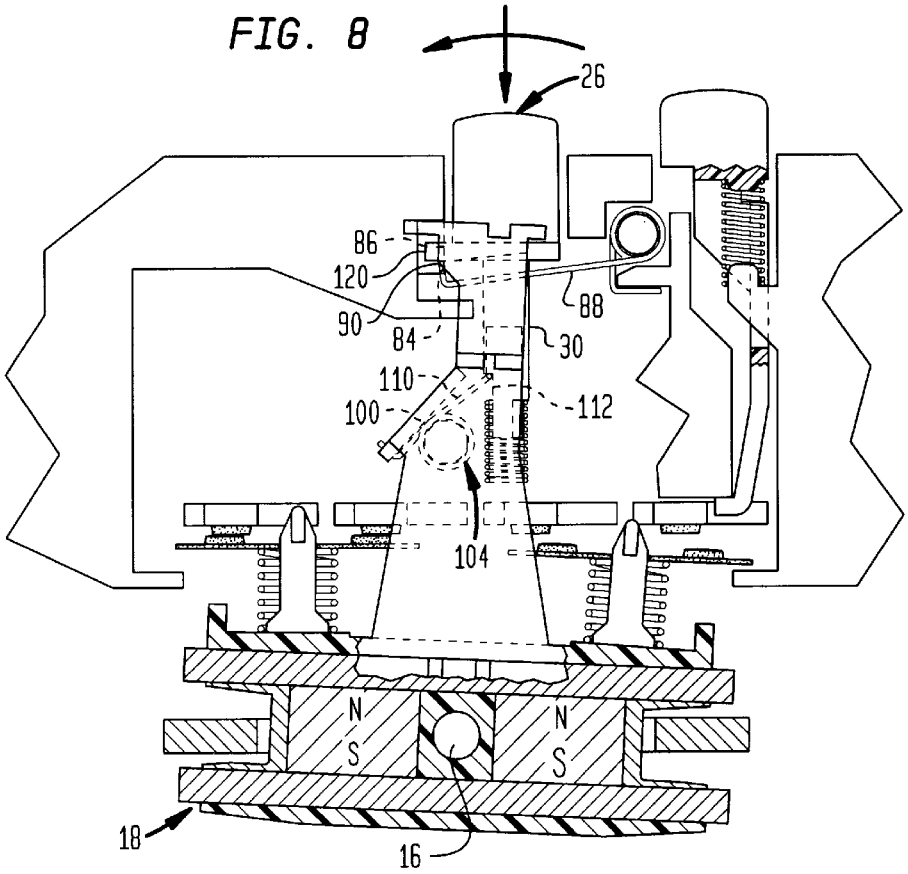
FIG. 8 illustrates the configuration of the components during a manual resetting operation.

FIG. 8 illustrates a manual reset operation. In this regard, the upper end 90 of the latch finger 88 includes a lateral extension (not shown) so that the same not only engages the latch surface 86, but also may extend past the same to underlie the ledge 120 as mentioned previously. As a consequence, the application of a downward force to the push button operator 26 will first cause the latch finger 88 to move to the position illustrated in FIG. 8, that is, unlatched from the latch surface 84, 86. The arrangement is such that as soon as the latch finger 88 is unlatched from the latch surface 84, 86, the notch 112 in the shank 30 of the push button actuator 26 will engage the reset finger 110 of the torsion spring 104. Continued depression of the push button operator 26 will cause the components to shift to the position illustrated in FIG. 9 whereat the armature 18 has been moved past center towards the stable position corresponding to a reset condition. At this point, the magnetic force provided by the permanent magnets 66 will be sufficient to cause the armature 18 to move fully to its stable, reset position.

It is to be observed that this occurs as a result of the engagement of the reset finger 110 with the notch 112, because of the fact that the reset finger 110 extends upwardly and at an angle towards the push button 26. Specifically, as the push button 26 moves downwardly, the reset finger 110 moves in a clockwise direction about the post 102 thereby increasing its effective length. Because the push button operator 26 has a fixed vertical path as viewed in the figures, the increasing of the effective length of the reset finger 110 can only act to drive the latch arm 24 in the counterclockwise direction around about the pivot 16, thereby moving the armature 18 over center and toward the reset one of its two stable positions.

Figure 9:
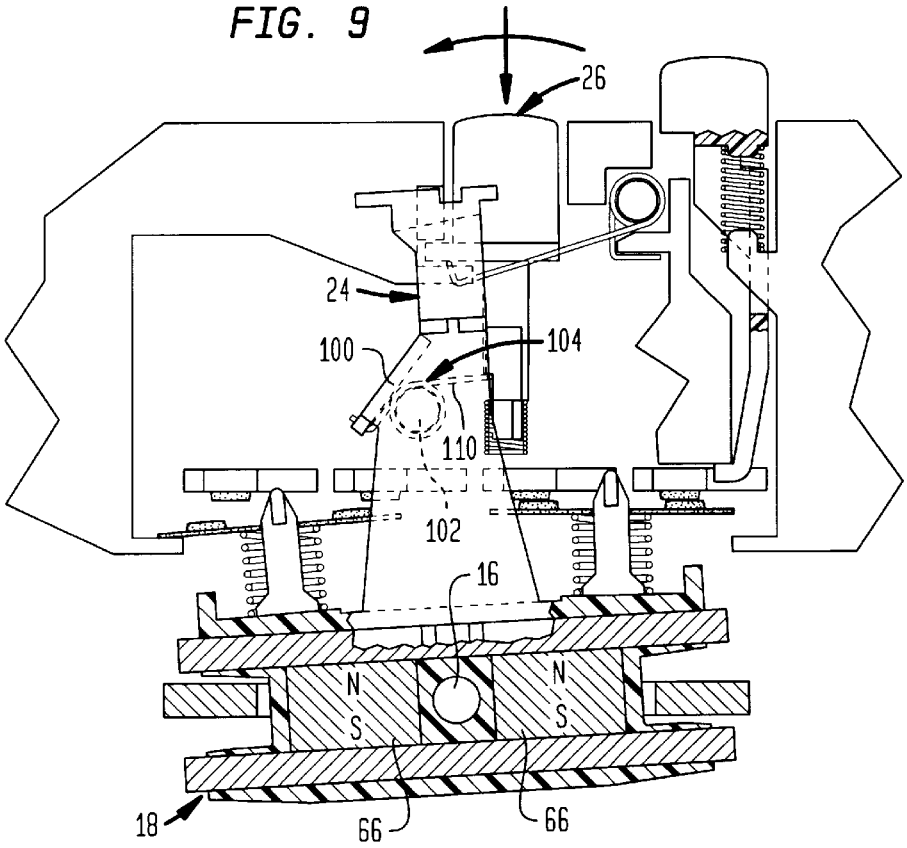
FIG. 9 illustrates the components in a configuration where manual resetting has almost completely occurred.

As seen in FIG. 9, the armature 18 has not quite reached its stable, reset position. However, as the magnets 66 take over and continue to move the armature 18 in that direction, it will be appreciated that the latch arm 24 will continue to move in the counterclockwise direction as will the post 102. This in turn will move the torsion spring 104 in the counterclockwise direction which in turn will ultimately result in the reset finger 110 being withdrawn from the notch 112. At this time, it may snap upwardly to stop against the projection 100 and the components will generally assume the configuration illustrated in FIG. 5.

Figure 10:
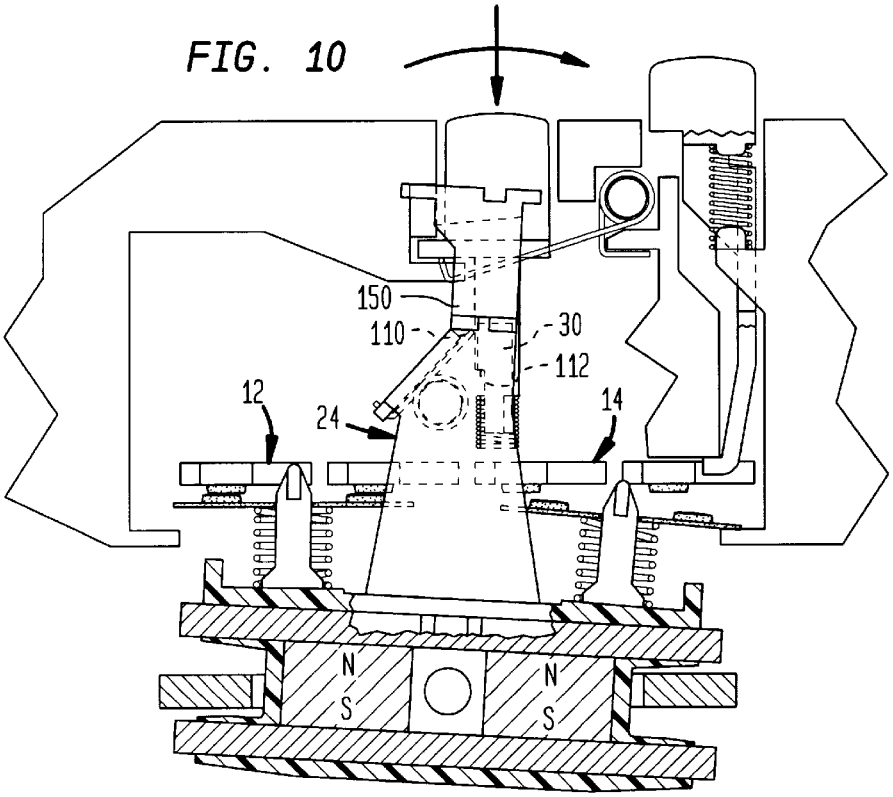
FIG. 10 illustrates the configuration of components after a trip with the reset push button being held down.

Reference is now made to FIGS. 5 and 6 to illustrate the trip free mode of operation of the trip mechanism. If the push button 26 is held or jammed down in an attempt to defeat the mechanism, it will be moved such that the notch 112 defining the stop surface on the shank 30 is below the end of the reset finger 110 when the armature 18 is in the stable, reset position. As a consequence, if a trip pulse is provided to the conductor 80 (FIG. 2), the reset finger 110 cannot engage the notch 112 but will merely come to rest against the side of the shank 30 as illustrated in FIG. 10 with the armature 18 shifting sufficiently to cause a trip by opening the normally closed fixed contacts 14 and closing the normally open fixed contacts 12, all as illustrated in FIG. 10. In this regard, it may be desirable to place a slight undercut in a side of the shank 30 as indicated at 150 to assure that movement of the latch arm 24 to the tripped position cannot be stopped short of the desired goal by interference between the shank 30 and the upper end of the reset finger 110.

As generally alluded to previously, the stop operator 32 may be manually depressed to bring its lower end 130 into engagement with the contact bar 50 forming part of the normally closed circuit of the relay to momentarily open the same. This is illustrated in FIG. 11.

Figure 12:
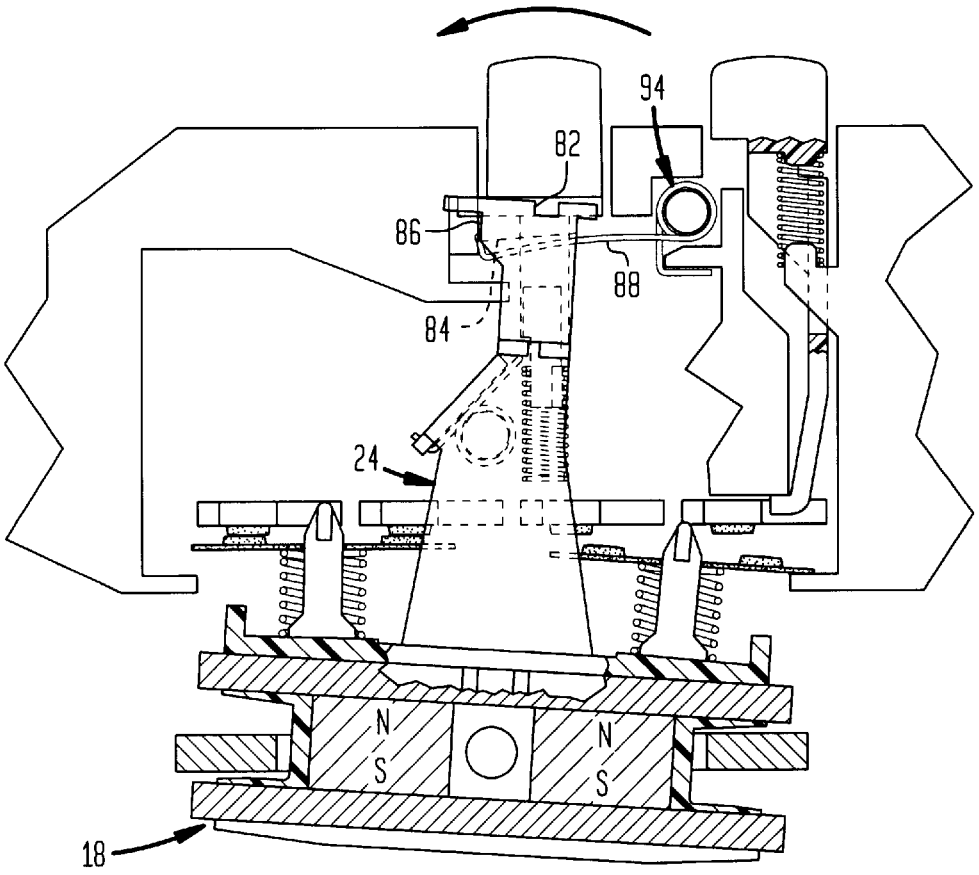
FIG. 12 illustrates a configuration of components when, for test purposes, the relay is being set or reset.

Turning now to FIGS. 1 and 12, it will be readily appreciated that through the use of a tool placed in the notch 82, the mechanism can be switched from the reset position illustrated in FIG. 1 to a tripped position when there is nothing other than the magnetic force provided by the magnet 66 to resist motion of the latch arm 24 in a clockwise direction. Conversely, to move the armature 18 from the stable, tripped position towards the reset position for test purposes, some resistance may be encountered as a result of the latch finger 88 being engaged with the latch surface 84, 86. However, it will be appreciated that the torsion spring 94 of which the latch finger 88 is part, while being strong enough to resist switching when a low voltage, low current pulse is applied by semi-conductor control circuitry for the mechanism, is insufficiently strong to resist a manually applied force applied to the notch 82 as by the tip of a screwdriver of the like. Thus, as seen in FIG. 2, the spring finger 88 may flex in response to such force and will slip off of the latch surface 86 and 88 to allow the armature 18 to be returned to the reset position.

A number of functions accrue from the foregoing. For one, the desirable manual reset, automatic reset and trip free modes of operation are provided by the relay. In addition, the relay mechanism provides a stop function as well as a manual means of testing the relay by moving the armature 18 between its two stable positions notwithstanding the presence of the spring finger 88.

Importantly, the unique arrangement of the contact bars 42 and 50 in connection with the fulcrums defined by the cross members 46 and 60 and the pivotally mounted armature 18 not only cause the contacts to open and close by moving closer or farther from one another, it also provides a wiping action as the contacts on the contact bars 42 and 50 move laterally with respect to the fixed contacts of the pairs 12 and 14 during opening and closing. This assures good electrical contact even in low voltage and/or low current situations.

Moreover, the particular configuration of the contact bars 42 and 50 and the respective posts 44, 46 together with the biasing springs 48 and 58 decreases the amount of electrical power required to move the armature 18 between its two stable positions. Specifically, spring force at the closed set of contacts provides a force that is additive to the force provided by the conductor 80 (FIG. 2) tending to switch the relay from one stable condition to another. Furthermore, when the open contact bar 42 or 50 is bottomed out against the associated leveling rib 134, 136, its spring force also tends to aid the magnetic force provided by current flowing through the coil 80 to again reduce the power requirement.

Figure 13:
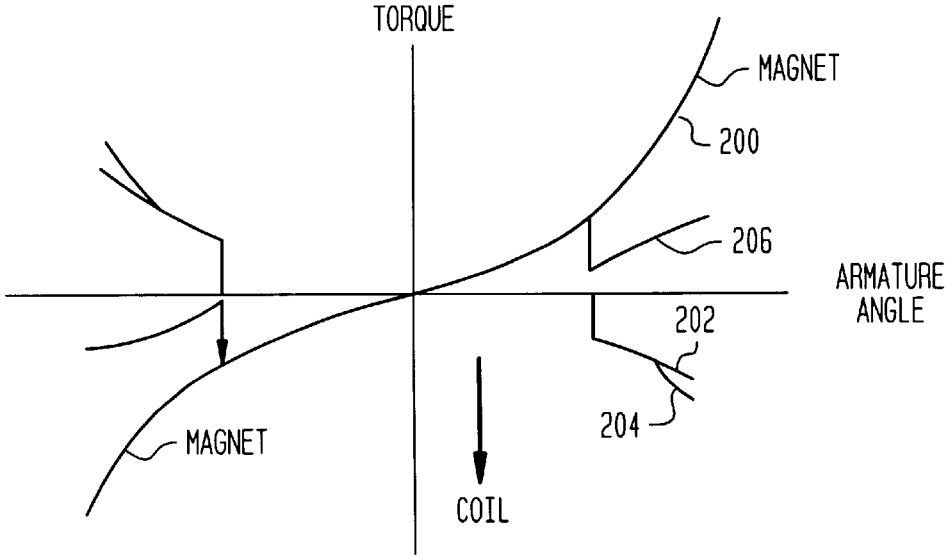
FIG. 13 is a graph illustrating spring forces involved in changing the relay from one stable condition to another.

FIG. 13 is a force diagram illustrating the advantages of the unique configuration of the contact and the leveling ribs herein. A line 200 plots the magnetic force required to shift the armature 18 from one of its two stable positions to the other dependent upon the angle of the armature with respect to a centered position. At the centered position, the torque required is zero.

A line 202 plots the force acting oppositely of the magnetic force that results from compression of the spring biasing one of the contact bars towards its associated fulcrum. For example, with reference to FIG. 1, the line 202 shows the force applied to the system by compression of the coil spring 58 against the contact bar 50.

Still another line 204 illustrates the application of force in opposition to the magnetic force that results from the open contact bar settling out against the associated leveling rib. With reference to FIG. 1, this would be contact of the contact bar 44 with the leveling rib 134.

The resultant of the forces represented by the lines 200, 202 and 204 is shown at 206. It will be immediately appreciated that the resultant force is considerably less than the force required to overcome the magnetic forces of the system. This translates to a considerably lesser requirement for power to operate the system than would be the case if the sole forces involved were those of the magnetic part of the system. This in turn means that in a self powered overload relay system such as is disclosed in the previously identified Zuzuly patent, even upon start up, when there is little opportunity to accumulate the power in a capacitor or the like, there will be sufficient power to trip the relay because of the very low power requirements due to the unique construction mentioned above. Those skilled in the art will immediately recognize this to be an important feature because very often, particularly when the piece of electrical equipment being monitored is a motor, the same may be jammed at start up and an undesirable overload will be present from the very beginning of an operational sequence for the piece of equipment. Thus, protection for the piece of equipment is maximized, providing adequate protection, even for an overload at startup.

Figure 14:
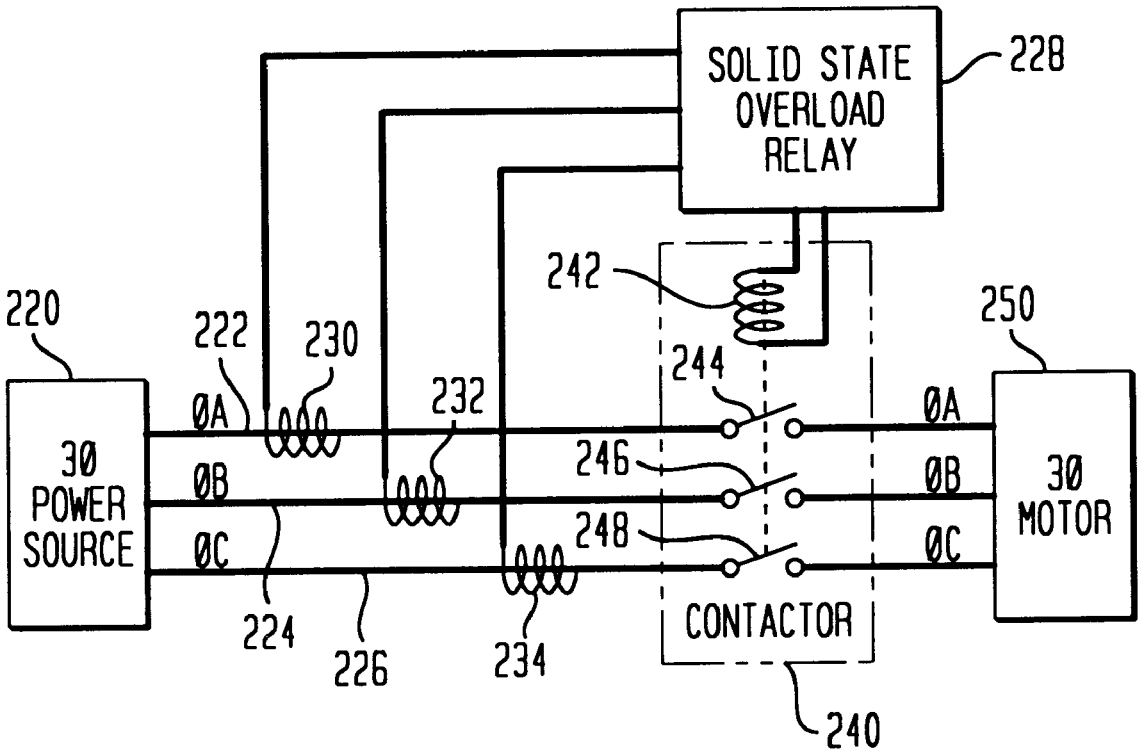
FIG. 14 is a schematic of a power source, a solid state overload relay incorporating a trip mechanism made according to the invention, a contactor and a load.

FIG. 14 is a schematic illustrating an intended environment of use of the invention. A three-phase power source is schematically illustrated at 220 and includes outputs on lines 222, 224 and 226. The first phase is carried on the line 222; the second phase on the line 224, and a third phase on line 226. A solid state relay circuit which may be identical to that described in the previously identified Zuzuly patent is schematically illustrated at 228 and includes sensors for each of the lines 222, 224, 226 as well as the trip mechanism herein described. The sensors may be conventional current transformers and are designated 230, 232, and 234. As can be ascertained from the previously identified Zuzuly patent, the sensors 230, 232 and 234 sense current flowing through the lines 220, 224, and 226, respectively, and provide that information to the solid state relay circuit 228. The latter operates to determine when an overload is present depending upon the current sensed by the sensors 230, 232 and 234 and drives the coil 80 (FIG. 2) which in turn can shift the armature 18 between its two stable positions.

A conventional contactor 240 includes an internal coil 242 which may be energized to close contacts 244, 246 and 248 to control flow of power to a load such as a conventional three-phase motor 250. When the coil 242 is de-energized, the contacts 244,246 and 248 will open. The contactor coil 242 is typically connected in series with the contacts 52,54 which may be bridged by the contact bar 50 (FIG. 1). If an overload occurs, the armature shifts from the position shown in FIG. 1 to that shown in FIG. 4 with the result that the contacts 52,54 will no longer be bridged by the contactor bar 50. As a result, the coil 242 will no longer be energized and the contacts 244,246,248 of the contact 240 will open to halt the flow of electric power to the load 250.

Other functions provided by the overload relay 228, including the trip mechanism of the present invention which is incorporated therein, have been previously described and in the interest of brevity, will not be repeated.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An overload relay comprising:

a plurality of sensors, each adapted to be associated with a respective phase input to a multiple phase load to be monitored, for providing a signal representative of the current to the respective phase input;

an overload determining circuit connected to said sensors to receive said signal and operative in response thereto to provide at least an overload indicating signal in response to a determination that an overload exists; and a trip mechanism responsive to said overload signal and adapted to be connected in controlling relation to a contactor in series with the multiple phase load to be monitored and further adapted to cause said contactor to interrupt power flowing to the multiple phase load to be monitored when said overload indicating signal is received, said trip mechanism including a bi-stable armature mounted on a pivot for pivotal movement between two stable positions, fixed contacts within said trip mechanism, moveable contacts operated by said armature for movement to a closed position with said fixed contacts for one of said two positions and for movement to an open position relative to said fixed contacts for the other of said two positions, said contacts being adapted to be placed in series with said contactor, a latch surface on one of said armature and said trip mechanism, a spring mounted on the other of said armature and said trip mechanism and having a latch finger for engaging and retaining said armature in said other of said two positions; and an electrical winding connected to said overload determining circuit to receive said overload indicating signal therefrom and magnetically coupled to said armature for moving said armature from said one position to said other position when said overload indicating signal is received.

2. The overload relay of claim 1 further including a push button reciprocally mounted on said trip mechanism for movement toward and away from said latch finger to disengage said latch finger from said latch surface.

3. The overload relay of claim 2 further including a detent in said trip mechanism selectively engageable with said push button to hold said push button in a position engaging said latch finger to hold said latch finger out of engagement with said latch surface.

4. The overload relay of claim 3 wherein said latch surface is on said armature.

5. The overload relay of claim 1, wherein said armature is elongated and includes an elongated contact mounting post extending generally transverse to the direction of elongation of said armature, said movable contact including an elongated contact bar generally parallel to said armature, a fulcrum on said post and a biasing spring carried by said armature for biasing said contact bar into engagement with said fulcrum, whereby relative movement between said fixed and movable contacts produces a wiping action.

6. The overload relay of claim 5, wherein said fixed contacts include two spaced contacts adapted to be bridged by said contact bar, and further including a contact leveling rib mounted on said housing and adapted to be contacted by an end of said contact bar to limit movement thereof as said armature pivots to move said contact bar away from said fixed contacts.

7. An overload relay comprising:

a plurality of sensors, each adapted to be associated with a respective phase input to a multiple phase load to be monitored, for providing a signal representative of the current to the respective phase input;

an overload determining circuit connected to said sensors to receive said signal and operative in response thereto to provide at least an overload indicating signal in response to a determination that an overload exists;

a post extending from one side of said armature at a location spaced from said pivot;

a fulcrum on said post;

an elongated contact bar mounted intermediate its ends on said post;

a spring carried by said armature and biasing said contact bar against said fulcrum;

a pair of spaced, fixed contacts positioned to be bridged by said contact bar for one of said two positions and spaced from said contact bar for the other of said two positions; and a contact leveling rib for engaging said contact bar when said armature is in said other of said two positions;

said contacts being adapted to be connected in series with a contactor in series with the multiple phase load to be monitored.

8. The overload relay of claim 7, wherein said leveling rib is located to engage the contact bar on the side thereof to the side of the fulcrum remote from said pivot.

9. An overload relay comprising:

a plurality of sensors, each adapted to be associated with a respective phase input to a multiple phase load to be monitored, for providing a signal representative of the current to the respective phase input;

an overload determining circuit connected to said sensors to receive said signal and operative in response thereto to provide at least an overload indicating signal in response to a determination that an overload exists; and a housing containing said armature;

fixed contacts in said housing;

movable contacts operated by said armature for movement toward and away from said fixed contacts;

a moveable lever associated with said armature and operable to shift said armature from at least one of said two positions to the other of said two positions;

an operator for said lever including an element movable toward and away from said lever;

a spring finger carried at angle extending therefrom toward the one of said lever and said operator; and a stop surface on the other of said lever and said operator positioned to be engaged by said spring finger when said armature is in said one position and said operator is moved toward said lever and to disengage and release said spring finger when said armature has moved to the other of said two positions.

10. The overload relay of claim 9 wherein said operator comprises a push button.

11. The overload relay of claim 10 wherein said stop surface comprises on said push button and said spring finger is carried by said lever.

12. The overload relay of claim 9 wherein said overload determining circuit is a solid state circuit.

* * * * *